United States Patent [19]

Schmidt

[11] 4,386,729

[45] Jun. 7, 1983

[54] SELF-LOCKING DESIGN FOR OCTAGONAL CONTAINER

[75] Inventor: Dennis A. Schmidt, Fond du Lac, Wis.

[73] Assignee: International Paper Company, New York, N.Y.

[21] Appl. No.: 246,473

[22] Filed: Mar. 23, 1981

[51] Int. Cl.[3] ..... B65D 5/10

[52] U.S. Cl. ..... 229/39 R; 229/25; 229/41 C; 229/45 R

[58] Field of Search ..... 229/39 R, 23 A, 25, 229/28 R, 41 C, 45 R

[56] References Cited

U.S. PATENT DOCUMENTS

| | | | |
|---|---|---|---|
| 1,425,549 | 8/1922 | Scruby . | |
| 1,909,649 | 5/1933 | Bayless . | |
| 2,565,188 | 8/1951 | Welshenbach | 229/16 |
| 2,572,159 | 10/1951 | Kells | 229/45 R |
| 2,674,400 | 4/1954 | Ross | 229/37 |
| 2,844,296 | 7/1958 | Soja | 229/39 |
| 3,174,675 | 3/1965 | Rosenburg, Jr. | 229/41 |
| 3,294,221 | 12/1966 | Notko | 229/39 R |
| 3,302,853 | 2/1967 | Locke | 229/39 |
| 3,526,352 | 9/1970 | Swett | 229/39 |
| 3,539,090 | 11/1970 | Blasdell | 229/39 R |
| 3,873,017 | 3/1975 | Blatt | 229/41 |
| 3,907,194 | 9/1975 | Davenport | 229/23 |
| 4,101,022 | 7/1978 | Watkins | 206/45 |
| 4,114,795 | 9/1978 | Mulroy | 229/23 |
| 4,119,266 | 10/1978 | Dempster | 229/39 |
| 4,225,078 | 9/1980 | Croley | 229/41 |
| 4,260,100 | 4/1981 | Hoffman | 229/41 C |
| 4,289,267 | 9/1981 | Meryea | 229/39 R |

*Primary Examiner*—Herbert F. Ross

*Attorney, Agent, or Firm*—Penelope A. Smith

[57] ABSTRACT

An octagonal container having a unique bottom closure and a blank therefor are provided. The body of the octagonal container includes a pair of major wall panels, a pair of minor wall panels, and four corner wall panels. Each major and minor wall panel is foldably connected to a corner wall panel on either side. In the preferred embodiment, one of the minor wall panels is formed from two pieces, which are secured in overlapping relation to one another. The closure section includes a pair of rectangular major cover flaps, a pair of rectangular minor cover flaps, and four polygonal corner flaps. Each major cover flap is foldably connected to a major wall panel. Each corner flap is foldably connected to a corner wall panel. Each minor cover flap is foldably connected to a minor wall panel. In the preferred embodiment, one of the minor cover flaps is formed from two pieces, which are fastened in overlapping relation to one another. Each minor cover flap features a pair of locking tabs which are coextensive with the minor cover flap and are defined by one or more slit lines. A central horizontal score line runs between the locking tabs. Each major cover flap features a pair of vertical slots aligned in parallel. The closure is formed by folding the corner flaps inward at right angles to the corner wall panels and then folding the major cover flaps inward at right angles to the major wall panels to overlie the corner flaps. The minor cover flaps are folded inward at right angles to the minor wall panels to overlie the major cover flaps. Finally, each minor cover flap is folded along its central horizontal score line to release the pair of locking tabs, and each locking tab is inserted into the corresponding slot in a major cover flap to form a secure, flat-bottomed closure.

8 Claims, 5 Drawing Figures

SELF-LOCKING DESIGN FOR OCTAGONAL CONTAINER

BACKGROUND OF THE INVENTION

This invention relates to octagonal paperboard containers, and more particularly to a closure construction for such containers.

Octagonal containers made from the heavier grades of paperboard are widely used for transporting heavy items in bulk quantities. In the meat-packaging industry, for example, open-topped octagonal bins are used to transport palletized loads of meat through the packing plant. Such bins must be suitable for rapid manual assembly by plant workmen. However, the assembled bins must also be sturdy enough to carry heavy loads without tearing and to withstand stress during transportation and handling. The configuration of the bottom closure is critical in insuring that the bin meets these requirements.

SUMMARY OF THE INVENTION

An octagonal container having a unique bottom closure and a blank therefor is provided. The body of the octagonal container includes a pair of major wall panels, a pair of minor wall panels, and four corner wall panels. Each major and minor wall panel is foldably connected to a corner wall panel on either side. In the preferred embodiment, one of the minor wall panels is formed from two pieces, which are secured in overlapping relation to one another. The closure section includes a pair of rectangular major cover flaps, a pair of rectangular minor cover flaps, and four polygonal corner flaps. Each major cover flap is foldably connected to a major wall panel. Each corner flap is foldably connected to a corner wall panel. Each minor cover flap is foldably connected to a minor wall panel. In the preferred embodiment, one of the minor cover flaps is formed from two pieces, which are fastened in overlapping relation to one another. Each minor cover flap features a pair of locking tabs which are defined by a horizontal slit line, a vertical slit line and a portion of the vertical edge of the minor cover flap. The locking tabs are joined by a central horizontal score line. Each major cover flap features a pair of vertical slots aligned in parallel. The closure is fomed by folding the corner flaps inward at right angles to the corner wall panels and then folding the major cover flaps inward at right angles to the major wall panels to overlie the corner flaps. The minor cover flaps are folded inward at right angles to the minor wall panels to overlie the major cover flaps. Finally, each minor cover flap is folded along its central horizontal score line to release the pair of locking tabs, and each locking tab is inserted into the corresponding slot in a major cover flap to form a secure, flat-bottomed closure.

DETAILED DESCRIPTION OF THE INVENTION

Figure 1:
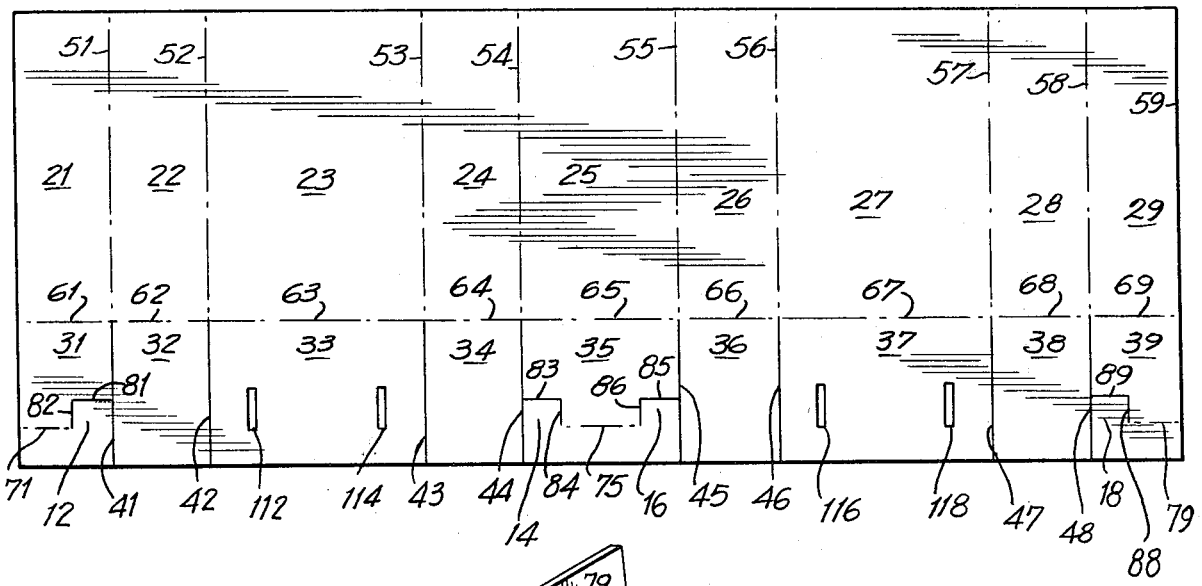
FIG. 1 is a plan view of a blank from which a bin embodying the present invention may be constructed.
Figure 2:
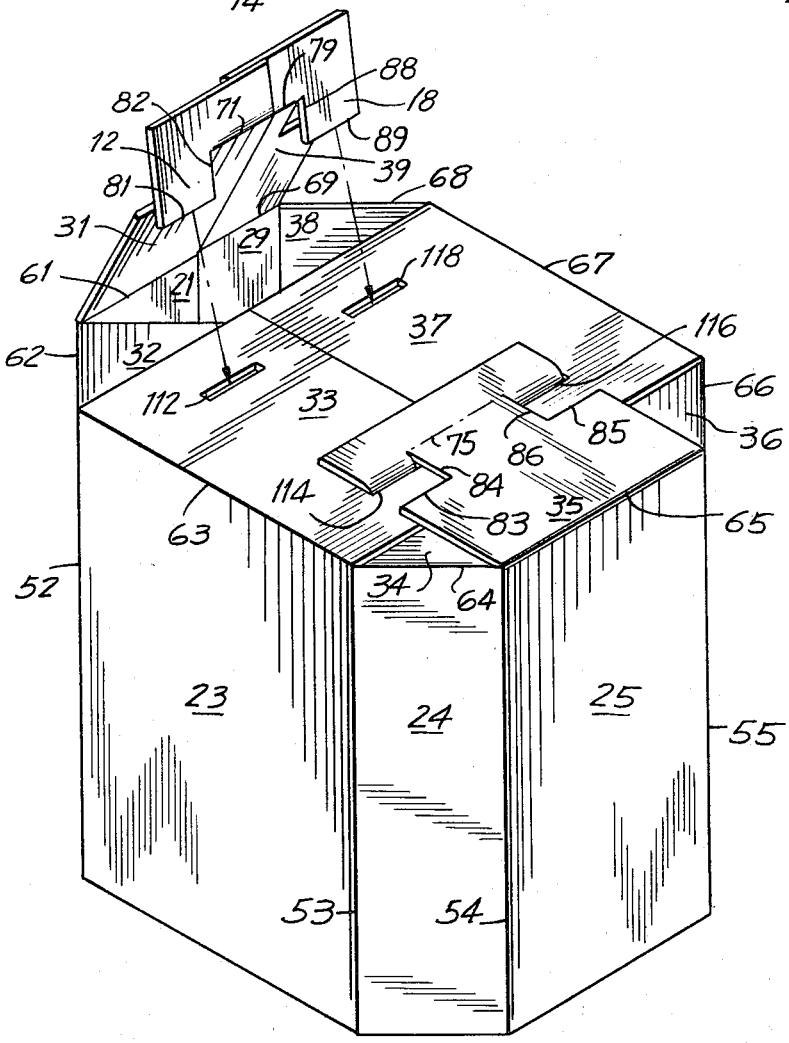
FIG. 2 is a perspective view of a partially assembled bin constructed from the blank of FIG. 1, the bin being shown in an inverted position to more clearly illustrate the bottom closure.
Figure 3:
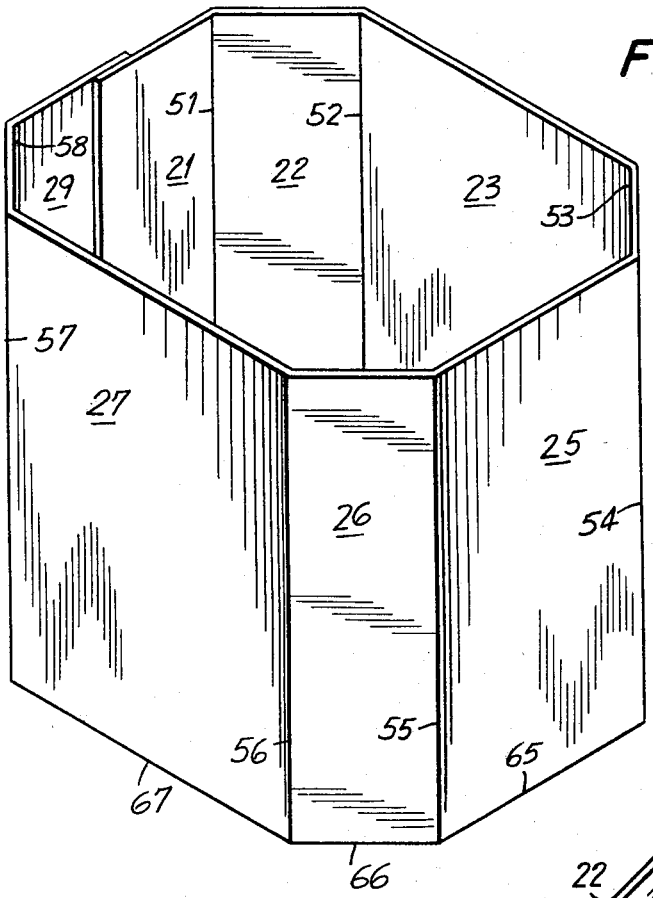
FIG. 3 is a perspective view of a fully assembled bin constructed from the blank of FIG. 1, the bin being shown in an upright position.
Figure 4:
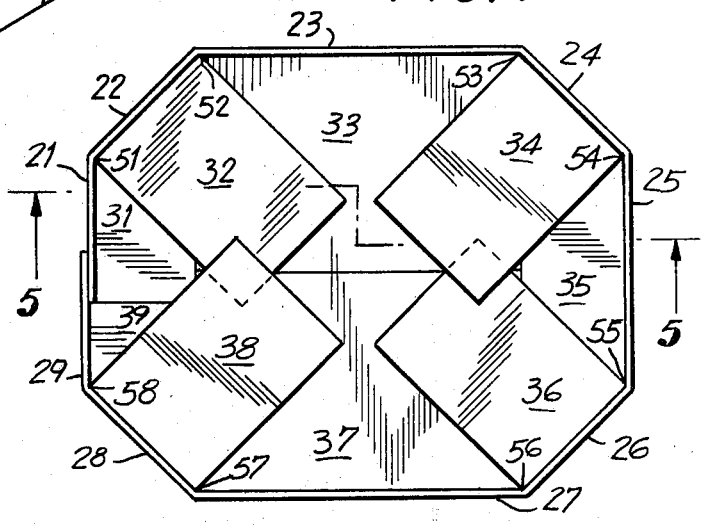
FIG. 4 is a top plan view of the bin of FIG. 5, showing the interior of the bin.
Figure 5:
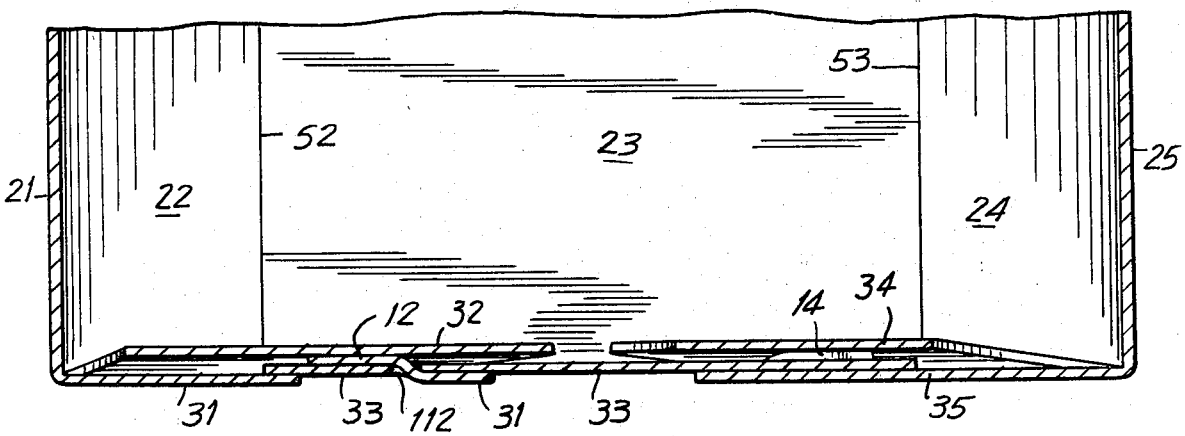
FIG. 5 is a cutaway view of the bottom closure of the bin, taken along line 5—5 of FIG. 4.

Referring now to the drawings, a blank for a bin constructed in accordance with one embodiment of the present invention is illustrated in FIG. 1. The blank includes a body section, indicated generally at 20, and a closure section, indicated generally at 30. For purposes of illustration, FIG. 2 shows the bin assembled from this blank in an inverted position to more clearly illustrate the construction of the bottom closure. FIGS. 3–5 show the bin in its upright position.

The blank is formed from a single sheet of foldable paperboard. The blank is preferably formed from corrugated board; single-wall or multi-wall board of various weights, with or without a water-resistant finish, may be chosen depending on the characteristics required of the finished container. The unfolded blank is rectangular in shape, to minimize board waste in manufacturing the blanks, and to facilitate stacking, shipping and storage of unassembled blanks.

The body section, 20, comprises a substantially rectangular first partial minor wall panel, 21, a pair of substantially rectangular major wall panels, 23 and 27, a substantially rectangular complete minor wall panel, 25, four substantially rectangular corner wall panels, 22, 24, 26, and 28, and a substantially rectangular second partial minor wall panel, 29. Each of the corner wall panels is foldably connected to a minor wall panel along one edge and to a major wall panel along the opposite edge so that major and minor wall panels are foldably connected in alternating series by the corner wall panels. In the illustrated embodiment, the major wall panels are wider than the minor wall panels, but embodiments in which the major wall panels are narrower than the minor wall panels are also within the scope of the invention. In the illustrated embodiment, the series begins and ends with a partial minor wall panel. In another embodiment, however, the series begins and ends with a partial major wall panel; in this embodiment the body section comprises a pair of minor wall panels, one complete major wall panel, four corner wall panels, a first and a second partial major wall panels. A blank having an eighth complete wall panel and a manufacturer's panel instead of seven complete and two partial wall panels is also within the scope of the invention. In this latter alternative embodiment, the series may begin with a corner wall panel, a major wall panel, or a minor wall panel, and the manufacturer's panel may be attached at either the beginning or the end of the series.

Referring again to FIG. 1, first partial minor wall panel 21 is foldably connected to corner wall panel 22 along vertical score line 51. Major wall panel 23 is foldably connected to corner wall panels 22 and 24 along vertical score lines 52 and 53 respectively. Complete wall panel 25 is foldably connected to corner wall panel 24 along vertical score line 54 and to corner wall panel 26 along vertical score line 55. Major wall panel 27 is foldably connected to corner wall panels 26 and 28 along vertical score lines 56 and 57 respectively. Corner wall panel 28 is foldably connected to second partial minor wall panel 29 along vertical score line 58.

The closure section comprises a first partial minor cover flap, 31, a pair of major cover flaps, 33 and 37, a complete minor cover flap, 35, four corner flaps, 32, 34, 46, and 38 and a second partial minor cover flap, 39. First partial minor cover flap 31 is foldably connected to first partial minor wall panel 21 along horizontal score line 61. Corner flap 32 is foldably connected to corner wall panel 22 along horizontal score line 62. Major cover flap 33 is foldably connected to major wall panel 23 along horizontal score line 63. Corner flap 34 is foldably connected to corner wall panel 24 along horizontal score line 64. Complete minor cover flap 35 is foldably connected to complete minor wall panel 25 along horizontal score line 65. Corner flap 36 is foldably connected to corner wall panel 26 along horizontal score line 66. Major cover flap 37 is foldably connected to major wall panel 27 along horizontal score line 67. Corner flap 38 is foldably connected to corner wall panel 28 along horizontal score line 68. Second partial minor cover flap 39 is foldably connected to second partial minor side panel 29 along horizontal score line 69.

In the preferred embodiment which is illustrated in FIGS. 1–5, all of the cover flaps are substantially rectangular in shape. Preferably, the combined heights of major cover flap 33 and major cover flap 37 equal the width of the container so that the assembled closure forms a substantially complete floor for the container.

Major cover flap, 33, features a pair of vertical slots, 112 and 114, placed at a predetermined distance from the edges of the flap 33. Major cover flap, 37, features a pair of vertical slots, 116 and 118, placed at a predetermined distance from the edges of flap 37. It is preferred that the length of each slot be about ⅓ of the height of the major cover flaps.

Each of the minor cover flaps comprises a pair of locking tabs coextensive with the minor cover flap and defined by at least one slit line. In the preferred embodiment, each tab is rectangular and is partially defined by one vertical edge of a minor cover flap; however, tabs which are bounded entirely by slit lines in the interior of a minor cover flap, and tabs which are rounded or polygonal in shape are also within the scope of this invention. In the preferred embodiment, a central horizontal score line runs across each minor cover flap between the two locking tabs in a substantially collinear relation to the junction between the tabs and the minor cover flap. It is preferred that the central horizontal scoreline be lower on the minor cover flap than the slit lines defining the locking tabs, i.e. that the tabs be joined to the minor cover flap at their lower ends. Thus, in the illustrated embodiment, partial minor cover flap, 31, features a locking tab, 12, defined by vertical slot line, 82, horizontal slit line, 81, and a portion of right vertical edge 41. A horizontal scoreline, 71, extends across flap 31 from the lower end of vertical slit line 82 to the left vertical edge of flap 31. Partial minor cover flap, 39, features a locking tab, 18, defined by vertical slit line, 88, horizontal slit line, 89, and a portion of left vertical edge 48. A horizontal scoreline, 79, extends across flap 39 from the lower end of vertical slit line 88 to the vertical edge of flap 39. Complete minor cover flap, 35, features a pair of locking tabs, 14 and 16, which are joined by a horizontal score line 75. Locking tab 14 is defined by vertical slit line 84, horizontal slit line 83, and a portion of left vertical edge 44. Locking tab 16 is defined by vertical slit line 86, horizontal slit line 85, and a portion of right vertical edge 45. Horizontal score line 75 extends across the central portion of flap 35 from the lower end of vertical slit line 84 to the lower end of vertical slit line 86.

It will be obvious from the drawings that the location of the locking tabs and horizontal score lines is determined by the distance between the slots and the edges of the major cover flaps. It will also be obvious to those skilled in the art that when the tabs are located within the interior of the minor cover flap, extensions of the central horizontal score line will run from the outer edges of the tabs to the edges of the minor cover flap. An alternative embodiment in which each minor cover flap features a horizontal scoreline running across the entire width of the flap and a pair of vertical slit lines running from the lower edge of the flap to the horizontal scoreline is also within the scope of the invention. Furthermore, the width of each locking tab is preferably slightly less than the length of the slots, and the height of each tab should be sufficient to insure a good lock in the assembled container. It is preferred that the height of each tab be about 1/6 to ⅓ of the height of the minor cover flaps.

In the closure section, adjacent flaps are not connected, but are separated by vertical slit lines or narrow vertical slots. In the illustrated embodiment, slit lines are used. If slots are used, the width of the slots should be determined as a function of the weight and thickness of the board. Thus, for example, it is preferred that the width of the slots be about ⅜" when board with basis weights in the range of 126–300 is used. In some instances, the formation of narrow notches rather than slits may facilitate folding of the blank. The preferred width of the vertical slots 112, 114, 116, and 118 will depend on the grade of the board used to form the blank. The width of vertical slots is preferably about ⅜" when board with basis weights in the range of 126–300 is used.

Referring now to FIGS. 2–5, blank 11 is assembled to form bin 10 by first folding blank 11 along vertical score lines 51, 52, 53, 54, 55, 56 57, and 58 to form an octagonal tube. First partial minor wall panel 21 and first partial minor cover flap 31 are secured in overlapping relation to second partial minor wall panel 29 and second partial minor cover flap 39 respectively by some suitable securing means, such as adhesive or staple. Horizontal score line 71 will overlap horizontal score line 79 or vice-versa to form a continuous score line connecting locking tab 12 to locking tab 18. The partially assembled bin may then be inverted, as shown in FIG. 2, to facilitate the assembly of the bottom closure.

The first step in assembling the bottom closure of the present invention is folding each of the corner flaps, 32, 34, 36 and 38 inward at right angles to the attached corner wall panels 22, 24, 26 and 28.

Next, major cover flap 33 is folded inward at right angles to major wall panel 23 and major cover flap 37 is folded inward at right angles to major wall panel 27. As shown in FIGS. 2 and 4, major cover flap 33 externally overlaps portions of corner flap 32 and corner flap 34 while major cover flap 37 externally overlaps portions of corner flap 36 and corner flap 38. Finally, the locking tabs are released by flexing each minor cover flap outward along its central horizontal score line, the minor cover flaps are folded inwardly at right angles to the adjacent minor wall panels, and each locking tab is inserted into the corresponding slot in one of the major cover flaps. It will be noted that in the preferred embodiment illustrated in the drawings, the locking tabs are directed back toward the walls of the container in the assembled closure. Thus, the minor cover flap formed from first partial minor cover flap 31 and second partial minor cover flap 39 is flexed outward along horizontal score lines 71 and 79 to release locking tabs 12 and 18. Complete minor cover flap 35 is flexed outward along horizontal score line 75 to release locking tabs 14 and 16. Complete minor cover flap 35 is folded inward along horizontal score line 65 to overlie portions of corner flaps 34 and 36 and major cover flaps 33 and 37. Locking tab 14 is inserted into slot 114 and locking tab 16 is inserted into slot 116. FIG. 2 shows an inserted bin at this stage in the assembly process. The minor cover flap formed from first partial minor cover flap 31 and second partial minor cover flap 39 is folded inward along horizontal score lines 61 and 69 to overlie portions of corner flaps 32 and 38 and major cover flaps 33 and 37. Locking tab 12 is inserted into slot 112 and locking tab 18 is inserted into slot 118. The major cover flaps, minor cover flaps, and corner flaps together form a substantially complete floor for the bin, so that a separate floor pad is not required. In the assembled closure, each of the major cover flaps is caught between two minor cover flaps on the outside and a pair of locking tabs on the inside. The cutaway view of FIG. 5, for example, shows that major cover flap 33 lies between minor cover flap 31 and locking tab 12. The completed bin is upended, as shown in FIG. 3, for loading. The overlapping arrangement of the flaps promotes even stress distribution. Furthermore, in the preferred embodiment, the spring-like resiliency of the paperboard exerts a pinching action which tends to hold the major cover flaps in place between the minor cover flaps and the locking tabs so that the closure remains locked despite overloading and mishandling.

While the octagonal container illustrated in the drawings is an open-ended bin, it is obvious that a covered octagonal container with my novel bottom closure is also within the scope of my invention. For certain applications, it might be desireable to use my closure as the top closure instead of, or in addition to its use as the bottom closure for the container. In adapting this invention to various uses and conditions, many modifications will be obvious to those skilled in the art. In view of this, the following claims are intended to cover all modifications and variations which fall within the true scope and spirit of the invention.

What is claimed is:

1. An octagonal container comprising a body section and a closure section, the body section comprising a pair of major wall panels, a pair of minor wall panels, and four corner wall panels, each of the corner wall panels being foldably connected to a minor wall panel along one edge and to a major wall panel along the opposite edge so that the major and minor wall panels are foldably connected in alternating series by the corner wall panels;

the closure section comprising a pair of major cover flaps, a pair of minor cover flaps, and four corner flaps, each of the corner flaps being foldably connected to and folded inward at right angles to a corner wall panel;

each of the major cover flaps being foldably connected to and folded inward at right angles to a major wall panel in externally overlapping relation to the two adjacent corner flaps, and, each of the minor cover flaps being foldably connected to and folded inward at right angles to a minor wall panel in externally overlapping relation to the two adjacent corner flaps and the major cover flaps;

wherein the improvement comprises: a pair of integral locking tabs located in parallel, spaced relation to one another on each of the minor cover flaps, each locking tab being defined by slit lines extending across the central portion of the flap and being joined to the flap at the end of the locking tab furthest from the foldable connection between the flap and the adjacent minor wall panel, whereby each such locking tab extends inwardly from the junction joining tab and flap, and toward the foldable connection between the flap and the adjacent minor wall panel; and, a pair of slots located in spaced, substantially parallel relation to one another on each of the major cover flaps, each of the slots being aligned with and adapted to receive a locking tab in an abutting minor cover flap, and each locking tab being inserted into one of the slots whereby each major cover flap is caught between the two minor cover flaps on the outside and a pair of locking tabs on the inside to form a secure closure.

2. A container according to claim 1 wherein each minor cover flap further comprises a score line running between the pair of locking tabs in parallel, spaced relation to the foldable connection between the flap and the adjacent minor wall panel and in substantially collinear, non-overlapping relation to the junction between the locking tabs and the flap.

3. A container according to claim 2 wherein each of the major and minor cover flaps is substantially rectangular in shape, and wherein the combined heights of the major cover flaps are substantially equal to the width of the container, whereby the closure forms a substantially complete floor for the container.

4. A container according to claim 3 wherein each locking tab abuts and is partially defined by a portion of one of the edges of its minor cover flap substantially perpendicular to the foldable connection between the minor cover flap and the adjacent minor wall panel.

5. A paperboard blank for an octagonal container comprising a body section and a closure section;

the body section comprising a first partial minor wall panel, a pair of major wall panels, a complete minor wall panel, four corner wall panels and a second partial minor wall panel, each of the corner wall panels being foldably connected to a major wall panel along one edge and to a minor wall panel along the opposite edge so that the major and minor wall panels are foldably connected in alternating series by the corner wall panels, beginning and ending with a partial minor wall panel; and, the closure section comprising a first partial minor cover flap foldably connected to the first partial minor wall panel, a pair of major cover flaps, each major cover flap being foldably connected to a major wall panel, a complete minor cover flap foldably connected to the complete minor wall panel, four corner flaps, each corner flap being foldably connected to a corner wall panel, and a second partial minor cover flap foldably connected to the second partial minor wall panel;

wherein the improvement comprises: an integral locking tab located on each of the first and second partial minor cover flaps, defined by slit lines extending across the central portion of the flap, and joined to the flap at the end of the locking tab furthest from the foldable connection between the flap and the adjacent partial minor wall panel, whereby each such locking tab extends inwardly from the junction joining tab and flap, and toward the foldable connection between its flap and the adjacent partial minor wall panel;

a score line located on each of the first and second partial minor cover flaps, running in parallel, spaced relation to the foldable connection between the flap and the adjacent partial minor wall panel and in substantially collinear, non-overlapping relation to the junction between the locking tab and the flap;

a pair of integral locking tabs located in parallel, spaced relation to one another on the complete minor cover flap, each locking tab being defined by slit lines extending across the central portion of the flap and being joined to the flap at the end of the locking tab furthest from the foldable connection between the flap and the adjacent complete minor wall panel, whereby each such tab extends inwardly from the junction joining tab and flap end toward the foldable connection between the flap and the adjacent complete minor wall panel;

a score line located on the complete minor cover flap, running in parallel, spaced relation to the foldable connection between the flap and the adjacent complete minor wall panel and in substantially collinear, non-overlapping relation to the junctions between the locking tabs and the flap; and a pair of slots located in spaced, substantially parallel relation to one another on each of the major cover flaps, each slot being located in spaced, substantially perpendicular relation to the foldable connection between the major cover flap and the adjacent major wall panel, and being adapted to receive a locking tab.

6. A blank for an octagonal container comprising a body section and a closure section;

the body section comprising a pair of major wall panels, a pair of minor wall panels, four corner wall panels and a manufacturer's panel, each of the corner wall panels being foldably connected to a major wall panel along one edge and to a minor wall panel along the opposite edge, so that the major and minor wall panels are foldably connected in alternating series by the corner wall panels, the manufacturer's panel being foldably connected to the terminal panel in the series; and, the closure section comprising a pair of major cover flaps, a pair of minor cover flaps, and four corner flaps, each of the corner flaps being foldably connected to a corner wall panel;

each of the minor cover flaps being foldably connected to a minor wall panel; and each of the major cover flaps being foldably connected to a major wall panel;

wherein the improvement comprises: a pair of integral locking tabs located in parallel spaced relation to one another on each of the minor cover flaps, each locking tab being defined by slit lines extending across the central portion of the flap and being joined to the flap at the end of the locking tab furthest from the foldable connection between the flap and the adjacent minor wall panel, whereby each such locking tab extends inwardly from the junction joining tab and flap, and toward the foldable connection between the flap and the adjacent minor wall panel;

a score line located on each of the minor cover flaps, running in parallel, spaced relation to the foldable connection between the flap and the adjacent minor wall panel and in substantially collinear, non-overlapping relation to the junctions between the locking tabs and the flap; and a pair of slots located in spaced, substantially parallel relation to one another on each of the major cover flaps, each slot being located in spaced, substantially perpendicular relation to the foldable connection between the major cover flap and the adjacent major wall panel, and being adapted to receive a locking tab.

7. A paperboard blank for an octagonal container comprising a body section and a closure section;

the body section comprising a first partial major wall panel, a pair of minor wall panels, a complete major wall panel, four corner wall panels, and a second partial major wall panel, each of the corner wall panels being foldably connected to a major wall panel along one edge and to a minor wall panel along the opposite edge so that the major and minor wall panels are foldably connected in alternating series by the corner wall panels, beginning and ending with a partial major wall panel, and the closure section comprising a first partial major cover flap, a pair of minor cover flaps, a complete major cover flap, four corner flaps, and a second partial major cover flap, the first partial major cover flap being foldably connected to the first partial major wall panel, each of the minor cover flaps being foldably connected to a minor wall panel, the complete major cover flap being foldably connected to the complete major wall panel, each of the corner flaps being foldably connected to a corner wall panel, and the second partial major cover flap being foldably connected to the second partial major wall panel;

wherein the improvement comprises: a pair of integral locking tabs located in parallel spaced relation to one another on each of the minor cover flaps, each locking tab being defined by slit lines extending across the central portion of the flap and being joined to the flap at the end of the locking tab furthest from the foldable connection between the flap and the adjacent minor wall panel, whereby each such locking tab extends inwardly from the junction joining tab and flap, and toward the foldable connection between the flap and the adjacent minor wall panel;

a score line located on each of the minor cover flaps running in parallel, spaced relation to the foldable connection between the flap and the adjacent minor wall panel and in substantially collinear, non-overlapping relation to the junctions between the locking tabs and the flap;

a slot located in each of the first and second partial major cover flaps in spaced, substantially perpendicular relation to the foldable connection between its flap and the adjacent partial major wall panel; and, a pair of slots located in spaced, substantially parallel relation to one another on the complete major cover flap, each such slot being located in spaced, substantially perpendicular relation to the foldable connection between the flap and the adjacent complete major wall panel;

each of the four slots being adapted to receive one of the locking tabs.

8. A blank according to claim 5, 6, or 7 wherein each locking tab abuts and is partially defined by a portion of one of the edges of its minor cover flap substantially perpendicular to the foldable connection between the minor cover flap and the adjacent minor wall panel.

* * * * *